US006276024B1

(12) United States Patent
Galvan-Garza

(10) Patent No.: US 6,276,024 B1
(45) Date of Patent: Aug. 21, 2001

(54) EXFOLIATED BATH SPONGE

(76) Inventor: Jesus Javier Galvan-Garza, Platon 799, Guadalupe N.L. 67170 (MX)

( * ) Notice: Subject to any disclaimer, the term of this patent is extended or adjusted under 35 U.S.C. 154(b) by 0 days.

(21) Appl. No.: 09/206,119

(22) Filed: Dec. 4, 1998

(51) Int. Cl.[7] ..... A47K 7/02

(52) U.S. Cl. ..... 15/244.4; 15/118; 15/209.1; 15/229.11; 15/244.1; 300/21

(58) Field of Search ..... 15/209.1, 229.11, 15/229.14, 244.1, 244.3, 244.4, 227, 118

(56) References Cited

U.S. PATENT DOCUMENTS 5,613,897 * 3/1997 Thompson, Jr. ..... 15/229.11
5,727,277 * 3/1998 Chien ..... 15/229.11
5,947,564 * 9/1999 Chen ..... 15/229.11
6,092,257 * 7/2000 Chen ..... 15/229.11

* cited by examiner

*Primary Examiner*—Randall E. Chin
(74) *Attorney, Agent, or Firm*—Breiner & Breiner, L.L.C.

(57) ABSTRACT

An expiated bath sponge is described including a combination of a tubular element of elastic plastic mesh coupled with a smooth/abrasive sponge which has an abrasive surface on the outside and a smooth surface on the inside. A seam extends around the circumference of the sponge and forms ties at two diametrically opposed points on the seam. The sponge is fixed to the tubular element with the ties. Once the tubular element and the sponge are joined together there is a space between the tubular element and the smooth inside face of the sponge into which a hand may be inserted to manipulate the sponge as desired.

2 Claims, 4 Drawing Sheets

EXFOLIATED BATH SPONGE

FIELD OF INVENTION

The present invention refers to improvements to a plastic bath sponge, and more specifically to a scrubbing pad made from a tubular elastic element, joined to a smooth/abrasive sponge, in such a way that it is extremely easy to apply soap to the body and at the same time, if necessary, to scrub some part where there is a stain which is difficult to remove.

BACKGROUND OF INVENTION

From time immemorial, man has had to bathe, and for this purpose has made use of different implements, especially sponges or loofahs to help with the task.

Many contributions have been made to this field, but none of these has been able to resolve the inconvenience of combining a scrubbing pad with a sponge.

Much time and ingenuity were required to find the solution to this problem. Finally, after many tests, it was possible to resolve this simple yet demanding requirement.

There are currently many scrubbing pads on the market, including some with features resembling that which I intend to patent with the present application, and such is the case with patents issued in various countries around the world. However, the solutions found and patented are highly impractical and, in some cases, highly costly due to the method which has to be followed for their manufacture.

OBJECTS OF THE INVENTION

The object of this invention is to remove the above mentioned multiple drawbacks and at the same time, once and for all, provide a sponge which, by combining a sponge with an elastic tubular element, makes it possible to place a portion of solid, powdered or even liquid soap in the scrubbing pad itself, which is an unquestionable improvement over the implements known to date at the time of using the sponge.

DESCRIPTION OF PRESENTLY PREFERRED EMBODIMENTS

With reference to the Figures, the bath sponge which is the subject of the present invention comprises a combination of a body manufactured from a tubular element (1) of elastic plastic mesh which is joined to a smooth/abrasive sponge (2) which has on its outside an abrasive surface (3) with which it is possible to scrub any type of stain which may be present on an area to be cleaned, with greater asperity, and on its inside, a smooth surface.

Figure 1:
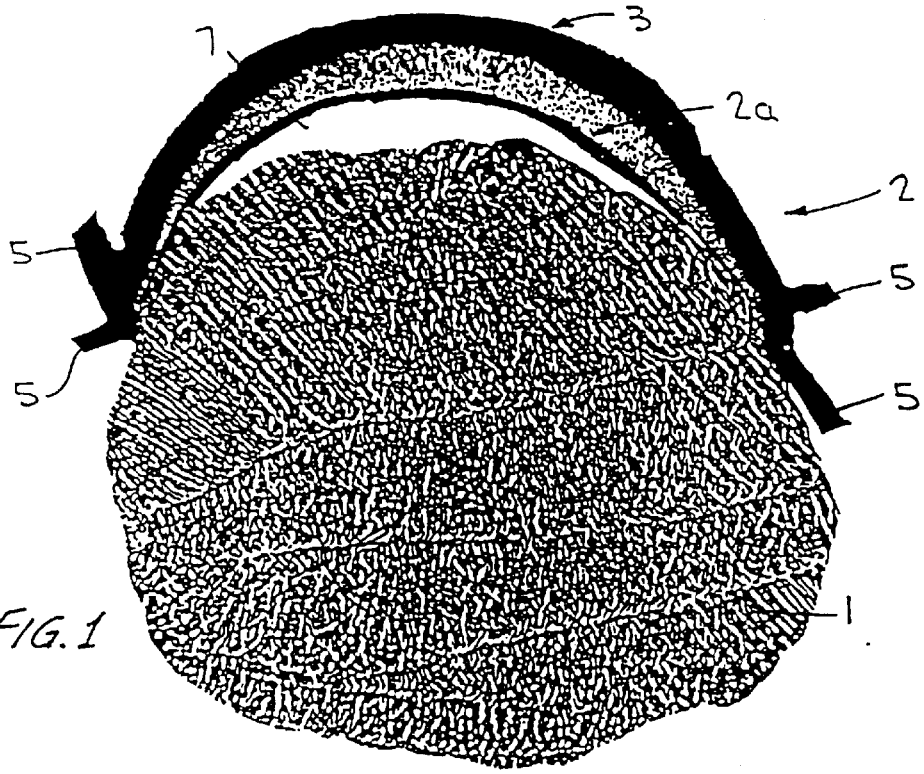
FIG. 1 shows an elevation of the exfoliated sponge.
Figure 2:
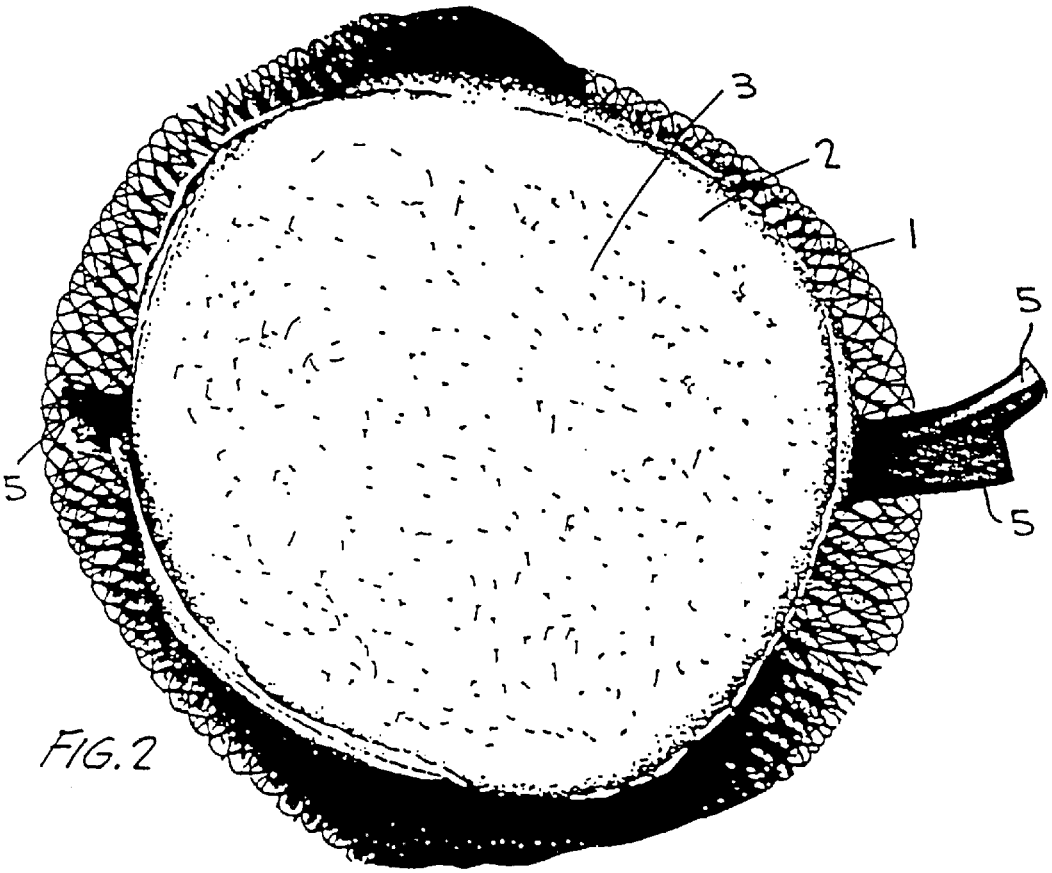
FIG. 2 shows a top view of the exfoliated sponge.
Figure 3:
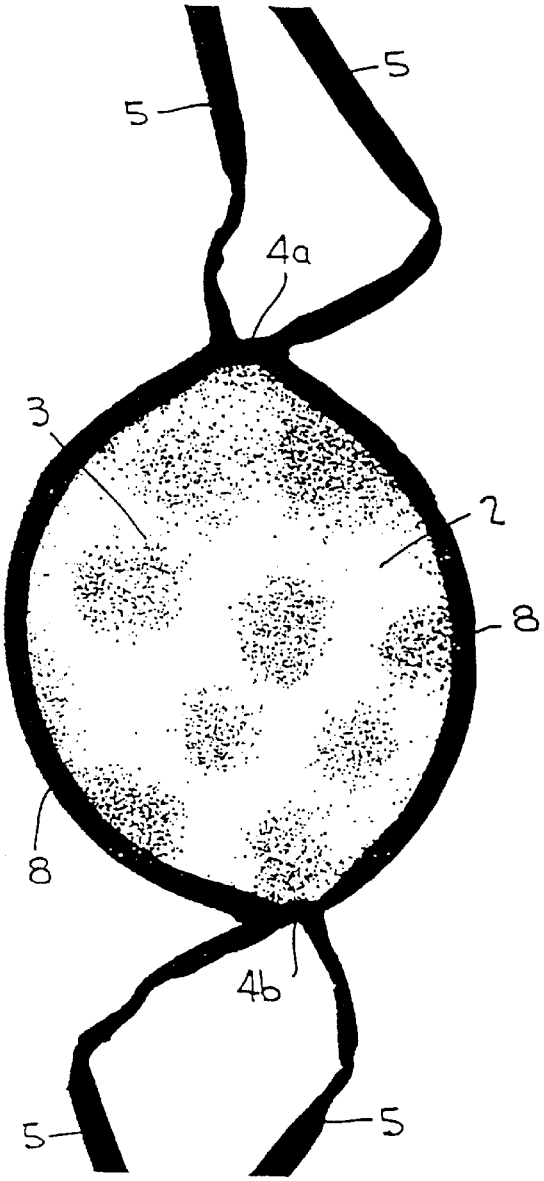
FIG. 3 shows the layout of the smooth/abrasive sponge.
Figure 4:
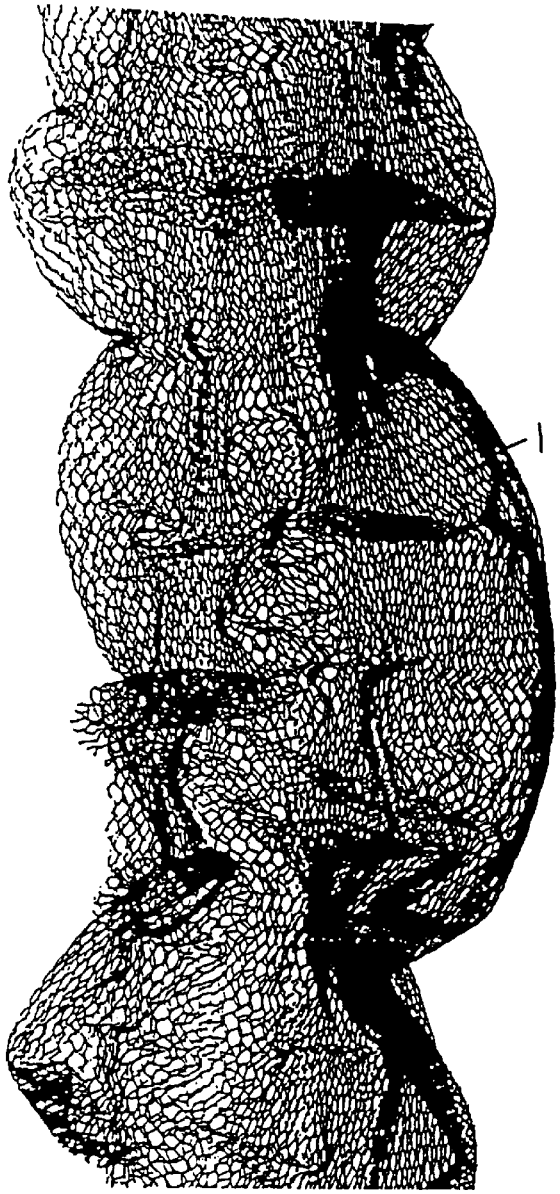
FIG. 4 shows an elevation of the elastic tubular element.
Figure 5:
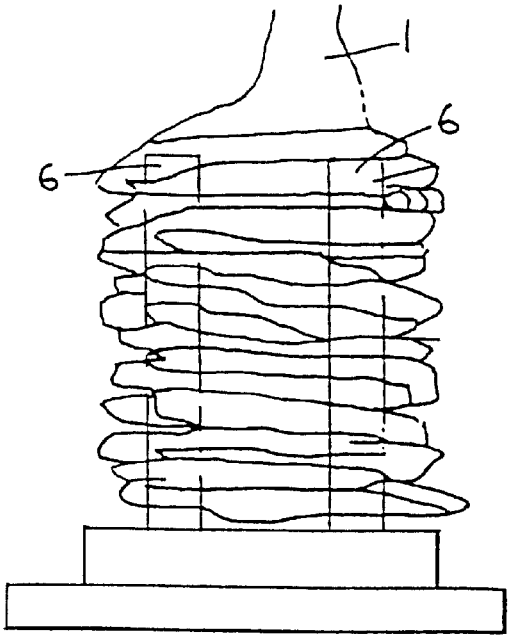
FIG. 5 shows a view illustrating how the elastic tubular element fits between separating posts.
Figure 6:
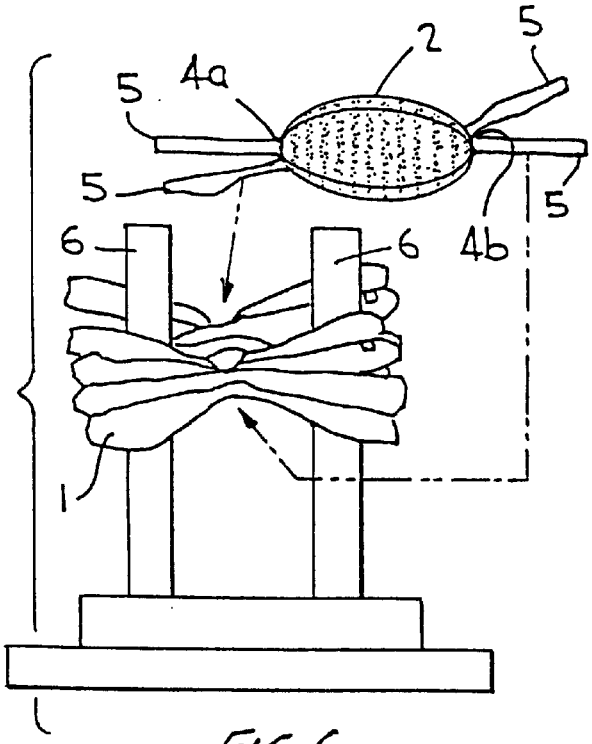
FIG. 6 shows a view illustrating how the elastic tubular element folds and is secured with ties.
Figure 7:
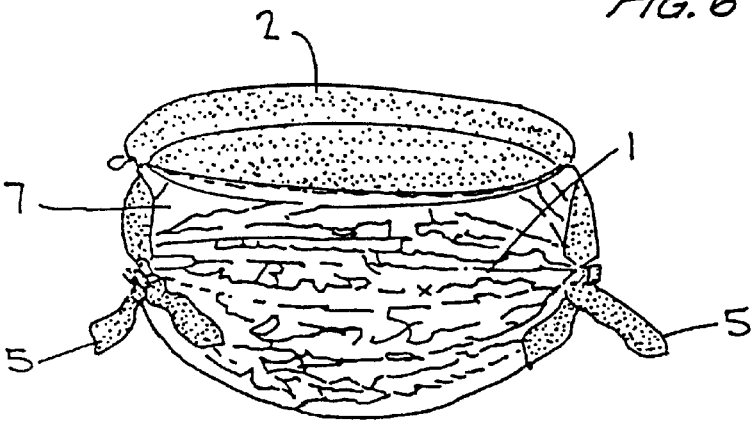
FIG. 7 shows how the exfoliated sponge is formed.
Figure 8:
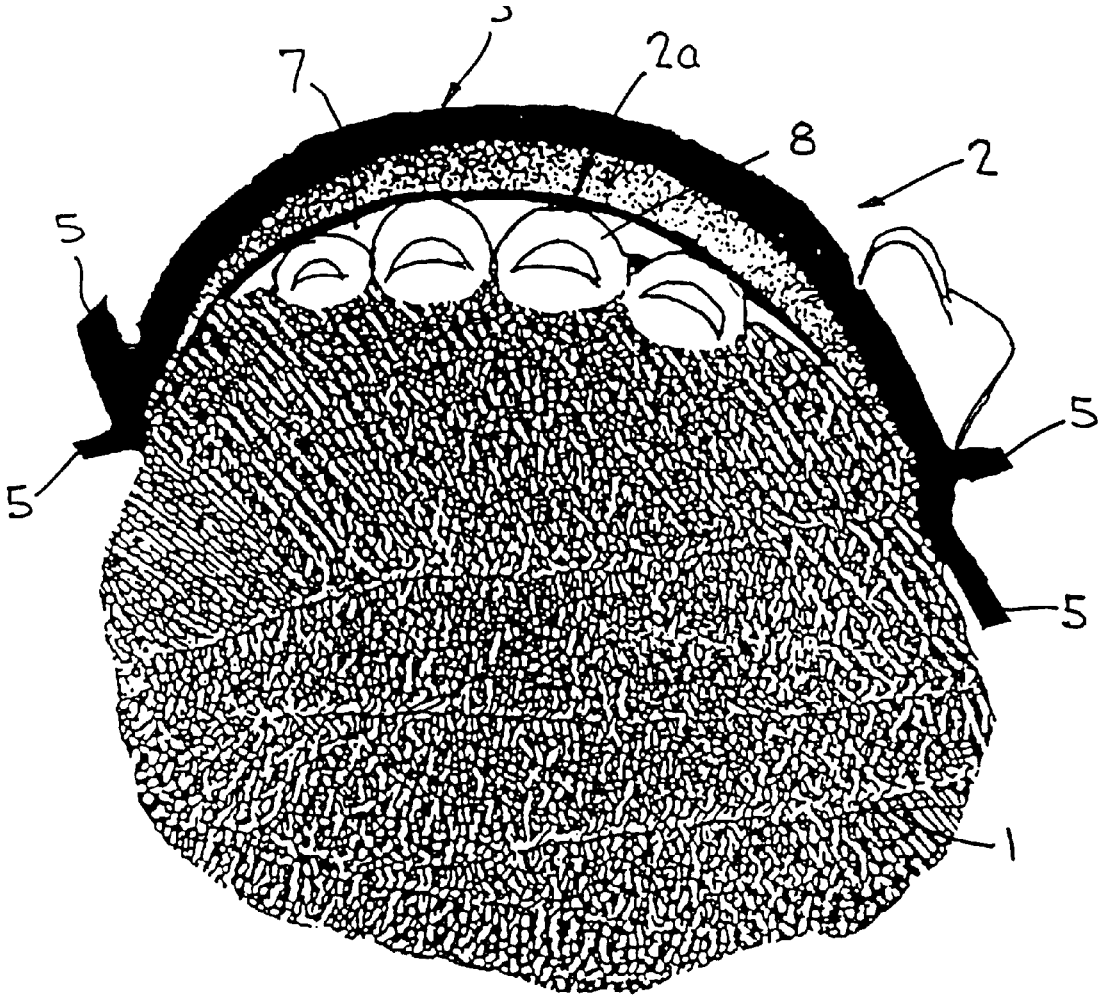
FIG. 8 shows a view illustrating how a hand is inserted between the elastic tubular element at the smooth side of the sponge.

The smooth/abrasive sponge (2) assumes an oval shape and has a seam (8) around the circumference. This seam (8) provides two ties (5), one at each point of the oval **(4*a*, 4*b*). The abrasive sponge is fastened to the tubular element (1) with the ties. To this end, the tubular element (1) is placed on two vertical posts (6) (see FIG. 5) so that the posts (6) fit inside the tubular element (1) and are fully inserted inside the tubular elastic element (1). When the posts are so inserted, one side of the tubular elastic element (1) is secured by means of the ties (5) (see FIG. 6) on one side (4*a*) of the smooth/abrasive sponge (2). When that side has been firmly secured, the other side (4*b*) of the tubular element (1) is secured with the ties (5) on the opposite side of the oval formed by the body of the smooth/abrasive sponge (2). When all is firmly tied together, the tubular element (1) is withdrawn from the posts (6)** and the exfoliated sponge is formed automatically.

Once the exfoliated sponge is formed, there is a space (7) between the elastic tubular element (1) and the smooth inside face **(2*a*) of the sponge (2) into which a hand (8)** may be inserted to manipulate the sponge as desired.

With the contribution of the present invention, it is perfectly easy to scrub any part of an area to be cleaned by simply applying soap to the tubular element and scrubbing the corresponding area with either of the two components, i.e. the tubular element or sponge (1, 2).

What is claimed is:

1. An exfoliated bath sponge comprising a tubular element of elastic plastic mesh; a smooth/abrasive sponge which has an abrasive surface on an outside face and a smooth surface on an inside face; and a seam which extends around a circumference of the sponge and which forms ties at two diametrically opposed points of the seam, the ties fixing the sponge to the tubular element; and wherein a space is present between the tubular element and the inside face of the sponge sufficient to receive a hand.

2. Method of making the exfoliated bath sponge according to claim 1, said method comprising placing the tubular element over two vertical posts so that said posts are fully inserted inside said tubular element; fastening the ties on one side of the sponge to one side of the tubular element and thereafter securing the ties on another side of the sponge to another side of the tubular element; withdrawing the tubular element from the posts to provide the exfoliated sponge.

* * * * *